United States Patent [19]

Hayashi

[11] Patent Number: 4,648,357

[45] Date of Patent: Mar. 10, 1987

[54] COOLING SYSTEM FOR AUTOMOTIVE ENGINE OR THE LIKE

[75] Inventor: Yoshimasa Hayashi, Kamakura, Japan

[73] Assignee: Nissan Motor Co., Ltd., Yokohama, Japan

[21] Appl. No.: 816,899

[22] Filed: Jan. 7, 1986

[30] Foreign Application Priority Data

Jan. 8, 1985 [JP] Japan ..... 60-1212
Mar. 5, 1985 [JP] Japan ..... 60-43260
May 30, 1985 [JP] Japan ..... 60-117184

[51] Int. Cl.[4] ..... F01P 3/22

[52] U.S. Cl. ..... 123/41.27; 123/41.44; 123/41.47

[58] Field of Search ..... 123/41.2–41.27, 123/41.44, 41.46, 41.47; 165/104.27, 104.32

[56] References Cited

U.S. PATENT DOCUMENTS 3,312,204 4/1967 Barlow ..... 123/41.25
4,545,335 10/1985 Hayashi ..... 123/41.27

FOREIGN PATENT DOCUMENTS 141363 5/1985 European Pat. Off. ..... 123/41.27

*Primary Examiner*—William A. Cuchlinski, Jr.
*Attorney, Agent, or Firm*—Schwartz, Jeffery, Schwaab, Mack, Blumenthal & Evans

[57] ABSTRACT

In order to permit return of coolant condensate from a radiator to the coolant jacket in which liquid coolant is boiled and the vapor used as a vehicle for removing heat from highly heated engine structure, and simultaneous boiling point control via varying the amount of liquid coolant present in the radiator, a dual pump arrangement is provided. The first returns the liquid condensate to the radiator while the second moves coolant between the radiator and a reservoir. In some embodiments the pump arrangements are mechanically driven by the engine in order to improve response to demands for coolant movement and thus ensure rapid control of deviations from required conditions.

17 Claims, 11 Drawing Figures

COOLING SYSTEM FOR AUTOMOTIVE ENGINE OR THE LIKE

BACKGROUND OF THE INVENTION

1. Field of the Invention

The present invention relates generally to an evaporative type cooling system for an internal combustion engine wherein liquid coolant is permitted to boil and the vapor used as a vehicle for removing heat therefrom, and more specifically to such a system which features a double pump arrangement which simultaneously enables (a) coolant condesate to be returned to the coolant jacket and (b) rapid control of pressure prevailing in the cooling circuit so as to offset any undesirable effects on temperature control that sudden changes in engine operation and/or ambient conditions might have.

2. Description of the Prior Art

In currently used "water cooled" internal combustion engines such as shown in FIG. 1 of the drawings, the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having an 1800 cc displacement (by way of example) is operated full throttle, the cooling system is required to remove approximately 4000 Kcal/h. In order to achieve this, a flow rate of 167 liter/min (viz., $4000-60\times\frac{1}{4}$) must be produced by the water pump. This of course undesirably consumes a number of otherwise useful horsepower.

FIG. 2 shows an arrangement disclosed in Japanese Patent Application Second Provisional Publication No. Sho. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to readily escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to come out of solution and form small bubbles in the radiator which adhere to the walls thereof and form an insulating layer. The undissolved air also tends to collect in the upper section of the radiator and inhibit the convention-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that when the engine is stopped and cools down the coolant vapor condenses and induces sub-atmospheric conditions which tend to induce air to leak into the system. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms pockets of air which cause a kind of "embolism" in the radiator and which badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the relatively dry gaseous coolant (steam for example) is condensed in a fan cooled radiator 8.

The temperature of the radiator is controlled by selective energizations of the fan 9 which maintains a rate of condensation therein sufficient to provide a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the bulky separation tank 6 also renders engine layout difficult.

Japanese Patent Application First Provisional Publication No. Sho. 56-32026 (see FIG. 4 of the drawings) discloses an arrangement wherein the structure defining the cylinder head and cylinder liners are covered in a porous layer of ceramic material 12 and wherein coolant is sprayed into the cylinder block from shower-like arrangements 13 located above the cylinder heads 14. The interior of the coolant jacket defined within the engine proper is essentially filled with gaseous coolant during engine operation at which time liquid coolant sprayed onto the ceramic layers 12.

However, this arrangement has proven totally unsatisfactory in that upon boiling of the liquid coolant absorbed into the cramic layers, the vapor thus produced and which escapes into the coolant jacket inhibits the penetration of fresh liquid coolant and induces the situation wherein rapid overheat and thermal damage of the ceramic layers 12 and/or engine soon results. Further, this arrangement is of the closed circuit type and is plagued with air contamination and blockages in the radiator similar to the compressor equipped arrangement discussed above.

FIG. 7 shows an arrangement which is disclosed in U.S. Pat. No. 4,549,505 issued on October 1985 in the name of Hirano. The disclosure of this application is hereby incorporated by reference thereto.

For convenience the same numerals as used in the above mentioned patent are also used in FIG. 7.

This arrangement while solving the problems encountered with the prior art has itself encountered the problem that it requires no less than four electromagnetic valves and a corresponding number of conduits in order to conduct the required coolant management during the various modes of engine operation. These valves are relatively expensive and the relatively large number of conduits tends to clutter the engine compartment.

In order to overcome this problem it has been proposed in copending U.S. Pat. application Ser. No. 751,536 filed on July 3, 1985 in the name of Hirano et al, to utilize an arrangement wherein two of the valves (134 and 156) of the FIG. 7 arrangement were replaced by a single three-way valve disposed in the coolant return conduit 132 at a location between the pump 136 and the coolant jacket 120.

This arrangement while greatly simplifying the valve and conduit arrangement via which communication between the reservoir and the cooling circuit per se of the engine and simultaneously enabling improved coolant control via the use of a reversible pump, has suffered from the problems that the three-way valve tends to be expensive and apt to jamming from time to time. Further, due to the inherent construction of the valve the discharge of the coolant return pump tends to be restricted. Accordingly, upon the whole system becomming heated to the point of being thermally saturated (such as tends to occur after prolonged high load operation) the coolant return pump is sometimes subject to a cavitation problem wherein vapor is generated in the pump chamber or chambers which vastly reduces the discharge thereof. This induces the serious problem that insufficient liquid coolant is returned to the coolant jacket and the level of coolant therein drops in a manner which invites localized dryouts and overheating.

One way of solving this problem is to introduce fresh cool liquid coolant into the system immediately upstream of the pump upon cavitation occuring. However, this inevitably varies the amount of coolant contained in the system and thus requires subsequent adustment at a latter time. Moreover, the number of valves and conduits is increased by this measure and as such the same drawback inherent with the FIG. 7 arrangement is encountered.

A further problem with the three-way valve type arrangement has come in that when the valve is set to return coolant to the coolant jacket it is impossible to adjust the amount of coolant in the radiator using the pump and valve. Under high load operation when boiling becomes particularly vigorous a substantial amount of coolant tends to "bump" and boil over to the radiator in liquid form. Under these circumstances the interior radiator becomes wetted and partially filled with liquid coolant and thus reduces the amount of "dry" surface area available for the coolant vapor to release its latent heat of evaporation at at time when the maximum heat exchange efficiency of the radiator is most important. In order to reduce this level the pump must be frequently energized with the three-way valve set to return the liquid coolant to the coolant jacket. However, under these conditions the above mentioned caviation problem is apt to occur and compound the tendancy for a liquid coolant shortage to occur in the coolant jacket. Simultaneously opportunities to pump coolant out of the system in a manner which drops the pressure and temperature therein are vastly reduced and thus a control dilemma is encountered.

Hence, a requirement to be able to maintain the coolant jacket safely filled with sufficient liquid coolant and to simultaneously manage the amount of coolant in the system for the purposes of temperature control, has come into existence.

It will be noted that the above mentioned patent application was not published prior the priority date of the instant application and as such does not constitute actual prior art. The above discussion has been made with the intent of clarifying the background of the instant invention and includes knowledge which is not known to those not directly connected with the instant patent application. The content of said application is hereby incorporated by reference thereto.

SUMMARY OF THE INVENTION

It is an object of the present invention to provide a evaporative cooling system for an automotive vehicle engine or the like which is able to simultaneously deal with both coolant condensate return requirements as well as those necessary for coolant temperature control.

In brief, the above object is achieved by an arrangement wherein in order to permit return of coolant condensate from a radiator to the coolant jacket in which liquid coolant is boiled and the vapor used as a vehicle for removing heat from highly heated engine structure, and simultaneous boiling point control via varying the amount of liquid coolant present in the radiator, a dual two pump arrangement is provided. The first pump returns the liquid condensate the to radiator while the other or others move coolant between the radiator and a reservoir.

In some embodiments the pumps are mechanically driven by the engine in order to improve response to demands for coolant movement and thus ensure rapid control of deviations from target values.

More specifically, the present invention takes the form of an internal combustion engine having a structure subject to high heat flux and a cooling system for removing heat from the engine which features: (a) a cooling circuit including: a coolant jacket formed about the structure, the coolant jacket being arranged to receive coolant in liquid form and discharge same in gaseous form; a radiator which fluidly communicates with the coolant jacket by way of a coolant transfer conduit and in which gaseous coolant produced in the coolant jacket is condensed to its liquid form; a return conduit leading from the radiator to the coolant jacket for returning coolant condensate from the radiator to the coolant jacket; and a return pump disposed in the return conduit, the return pump being selectively energizable to maintain a predetermined level of coolant in the coolant jacket; (b) a reservoir the interior of which is maintained constantly at atmospheric pressure; and (c) a volume control pump arrangement fluidly interposed between the reservoir and the cooling circuit for pumping coolant between the cooling circuit and the reservoir in a manner which varies the amount of coolant in the cooling circuit.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the embodiments of the present invention, it is deemed appropriate to discuss some of the basis features of the the cooling system to which the present invention applied.

Figure 5:
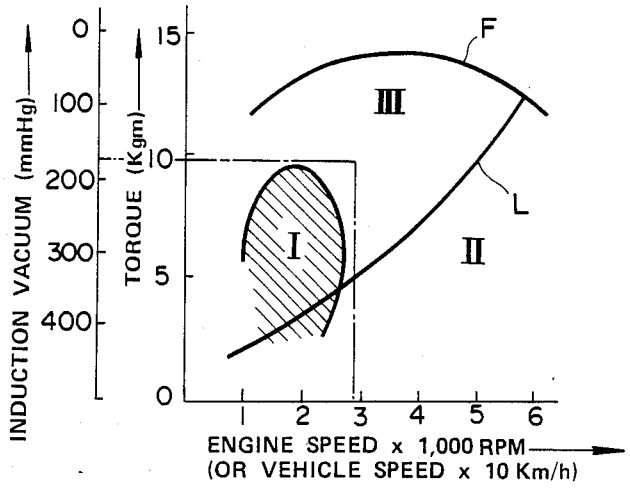
FIG. 5 is a graph showing in terms of induction vaccum (load) and engine speed the various load zones encountered by an automotive internal combustion engine.
Figure 6:
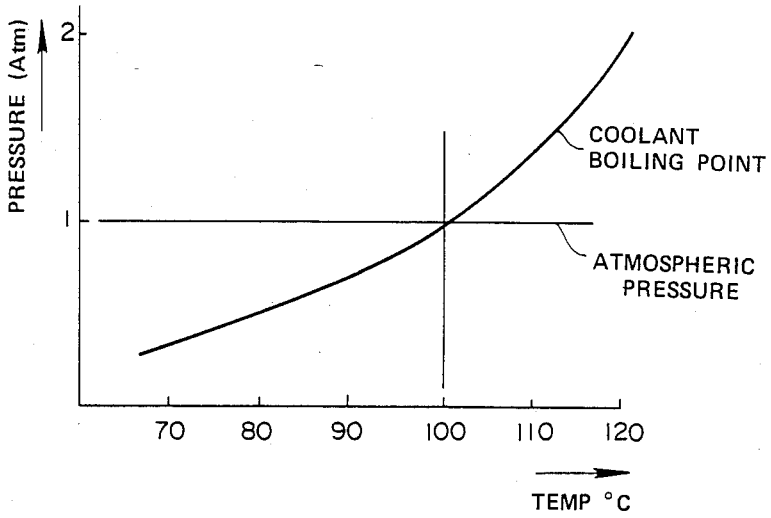
FIG. 6 is a graph showing in terms of pressure and temperature, the change in the coolant boiling point which occurs with change in pressure.

FIG. 5 graphically shows in terms of engine torque and engine speed the various load "zones" which are encountered by an automotive vehicle engine. In this graph, the curve F denotes full throttle torque characteristics, trace L denotes the resistance encountered when a vehicle is running on a level surface, and zones I, II and III denote respectively "urban cruising", "high speed cruising" and "high load operation" (such as hillclimbing, towing etc.).

A suitable coolant temperature for zone I is approximately 110° C. while 90°-80° C. for zones II and III. The high temperature during "urban cruising" promotes improved thermal efficiency and fuel economy while the lower values ensure that sufficient heat is removed from the engine and associated structure to prevent engine knocking and/or engine damage in the other zones (e.g. high speed cruising). For operational modes which fall between the aforementioned first, second and third zones, it is possible to maintain the engine coolant temperature at approximately 100° C. if so desired.

Figure 7:
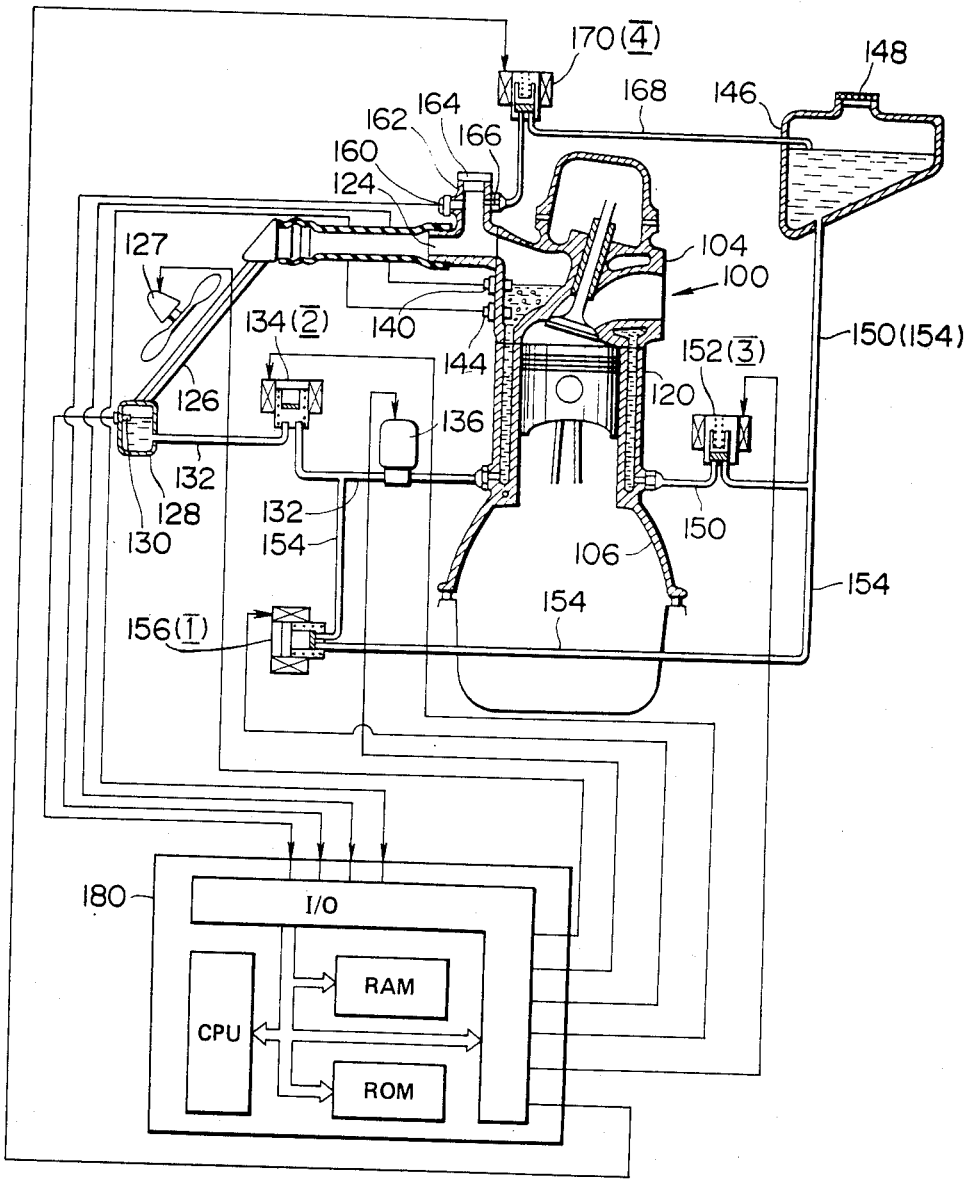
FIG. 7 shows in schematic elevation the arrangement disclosed in the opening paragraphs of the instant disclosure in conjunction with U.S. Pat. No. 4,549,505.

With the present invention, in order to control the temperature of the engine, advantage is taken of the fact that with a cooling system wherein the coolant is boiled and the vapor used as a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is of the closed circuit type. Thus, during urban cruising, by circulating only a limited amount of cooling air over the radiator, it is possible reduce the rate of condensation therein and cause the pressure within the cooling system to rise above atmospheric and thus induce the situation, as shown in FIG. 7, wherein the engine coolant boils at temperatures above 100° C. for example at approximately 119° C. (corresponding to a pressure of approximately 1.9 Atmospheres). In addition to the control afforded by the air circulation the present invention is arranged to positively pump coolant into the system so as to vary the amount of coolant actually in the cooling circuit in a manner which modifies the pressure prevailing therein. The combination of the two controls enables the temperature at which the coolant boils to be quickly brought to and held close to that deemed most appropriate for the instant set of operation conditions.

On the other hand, during high speed cruising, when a lower coolant boiling point is highly beneficial, it is further possible by increasing the flow cooling air passing over the radiator, to increase the rate of condensation within the radiator to a level which reduces the pressure prevailing in the cooling system below atmospheric and thus induce the situation wherein the coolant boils at temperatures in the order of 80° to 90° C. for example. In addition to this, the present invention also provides for coolant to be positively pumped out of the cooling circuit in a manner which lowers the pressure in the system and supplements the control provide by the fan in a manner which permits the temperature at which the coolant boils to be quickly brought to and held at a level most appropriate for the new set of operating conditions.

However, if the pressure in the system drops to an excessively low level the tendency for air to find its way into the interior of the cooling circuit becomes excessively high and it is desirable under these circumstances to limit the degree to which a negative pressure is permitted to develop. The present invention controls this by again positively pumping coolant into the cooling circuit while it remains in an essentially hermetically sealed state and raises the pressure in the system to a suitable level.

Figure 8:
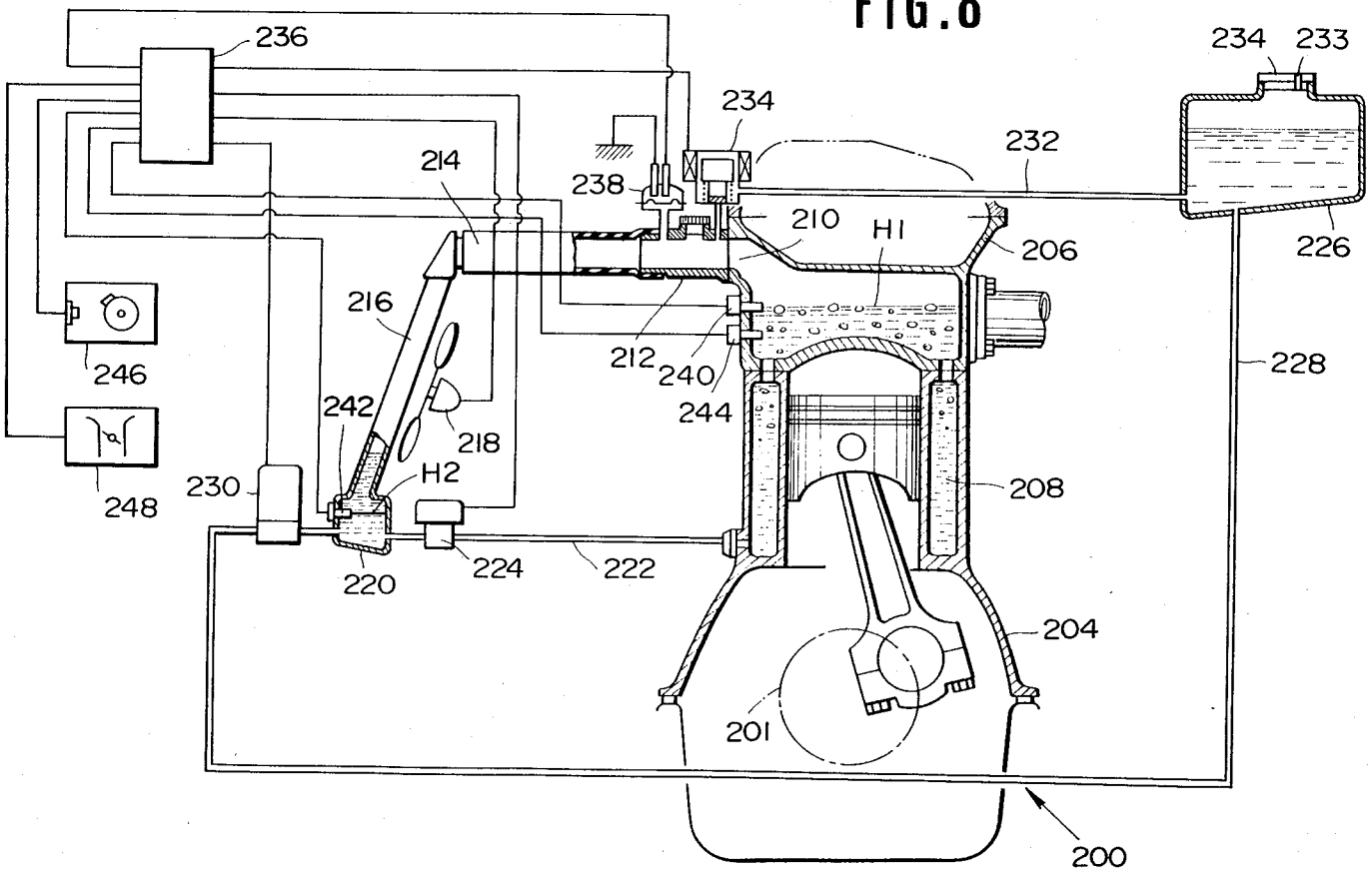
FIG. 8 shows in sectional elevation first embodiment of the present invention.

FIG. 8 of the drawings shows a first embodiment of the present invention. In this arrangement an internal combution engine 200 includes a cylinder block 204 on which a cylinder head 206 is detachably secured. The cylinder head and block are formed with suitably cavities which define a coolant jacket 208 about structure of the engine subject to high heat flux (e.g. combustion chambers exhaust valves conduits etc.,). Fluidly communicating with a vapor discharge port 210 formed in the cylinder head 206 via a vapor manifold 212 and vapor circuit 214, is a condensor 216 or radiator as it will be referred to hereinafter. Located adjacent the radiator 216 is a selectively energizable electrically driven fan 218 which is arranged to induce a cooling draft of air to pass over the heat exchanging surface of the radiator 216 upon being put into operation.

A small collection reservoir 220 or lower tank as it will be referred to hereinafter, is provided at the bottom of the radiator 216 and arranged to collect the condensate produced therein. Leading from the lower tank 220 to a coolant inlet port 221 is a coolant return conduit 222. A small capacity electrically driven pump 224 is disposed in this conduit at a location relatively close to the radiator 216.

A coolant reservoir 226 is arranged to communicate with the lower tank 228 via a conduit 228 and a reversible pump 230. The interior of the reservoir 226 is maintained constantly at atmospheric level via the provision of a small air bleed 233 or the like in the cap 234 which closes the filler port thereof.

In this embodiment the reversible pump 230 is electrically powered and arranged so that when not in operation it provides a hermetic seal between the reservoir 226 and the interior of what shall be termed and cooling circuit hereinafter (viz., a closed loop circuit comprised of the coolant jacket 204, the coolant manifold 212, vapor transfer conduit 214, radiator 216 and the coolant return conduit 222).

The reservoir 226 further communicates with the cooling circuit via a second conduit 232. As shown, this conduit leads from the reservoir 226 to the vapor manifold 212. An ON/OFF type electromagnetic valve 234 is disposed in this conduit. In this embodiment this valve (234) is arranged to assume an open state when de-energized and a closed on when supplied with electrical power from a control circuit 236. Conduit 232 is arranged to communicate with the highest section of the cooling circuit so as to facilitate the removal of contaminating air during a so called "non-condensible matter purse mode" which will be discussed hereinlater.

In order to detect the presence of a predetermined low pressure in the cooling circuit a pressure differential responsive switch device 238 is arranged to communicate with a vapor manifold 212. This switch 238 is arranged to issue a signal upon the pressure in the cooling circuit falling to a level in the order of −30 to −50 mmHg.

In order to maintain the highly heated structure of the engine (viz., the cylinder head, exhaust valve and ports etc.) immersed in sufficient liquid coolant to avoid the formation of localized dry-outs which tends to occur due to bumping and frothing of the coolant which accompanies vigorous boiling, a first level sensor 240 is disposed in the cylinder head 206 and arranged to sense the presence of coolant at a level H1. This level (H1) is selected to maintain the cylinder head and associated structure immersed in a depth of coolant adequate to avoid the above mentioned undesirable phenomenon which is apt to induce rapid engine damage.

A second level sensor 242 is disposed in the lower tank 220 and arranged to detect the presence of coolant a second predetermined level H2. This second level (H2) is selected in conjunction with level H1 so that when the level of coolant in the coolant jacket 208 is at level H1 and the level of coolant in the lower tank 220 is at level H2, the minimum amount of liquid coolant with which the system can safely operated is retained in the cooling circuit. With less than this amount of coolant has possibility that level H1 cannot be maintained comes into existance and thus the danger of engine damage due localized overheating or the like.

Located below the level sensor 240 so as to immersed in the liquid coolant and located relatively close to the highly heated structure of the engine is a temperature sensor 244. In this embodiment the temperature sensor takes the form of a thermistor the resistance of which varies with temperature. It will be noted that although a pressure sensor may be used in lieu of a temperature sensor, the latter tends to be subject to pressure pulsations which occur in the vapor coolection space defined in the coolant jacket above level H1 in a manner which renders stable control of the system difficult.

By placing the temperature sensor 244 close to the cylinder head it is possible to utilize a sudden increase in temperature indication as a warning that the level of coolant has dropped and insufficient coolant is contained in the coolant jacket 208.

As shown, the control circuit 236 receives the data inputs from the above mentioned sensors and in turn outputs control signals to the pumps 224, 230, valve 234 and the electrically driven fan 218. The control circuit 236 further receives data input from an engine speed sensor 246 and an engine load sensor 248. It will be noted that engine speed sensor 246 may take the form of a tap taken off the engine distributor in the event that an engine crankshaft angular displacement sensor is not available. As a load sensor the output of an air flow meter or a throttle valve position sensor may be used. Alternatively, if the engine is fuel injected the width of the injection control pulses may be used to indicate load while the frequency thereof used to indicate engine speed.

In this embodiment the control circuit 236 includes a microprocessor including a RAM, ROM, CPU and I/O interface or interfaces similar to the arrangement shown in FIG. 7 of the drawings. The ROM of this device contains predetermined control programs and/or schedules which permit the derivation of a temperature value which is optimal for the instant set of engine operational conditions. For, example it is possible to set a look-up take such of the nature shown in FIG. 5 and use the data inputs from the engine speed and load sensors 246, 248 to enable the coolant TARGET temperature as it will be referred to hereinlater, to be derived.

Alternatively, it is possible to directly obtain the appropriate temperature value by using a suitable algorithm in program form. As the various techniques for deriving the above mentioned TARGET value will be apparent to those skilled in that art of computer technology and engine control technique given that data available in FIG. 5 no further description will be given for brevity.

Prior the above arrangement being put into use, the cooling circuit is filled to brim with coolant (e.g. water, a mixture of water and a suitable anti-freeze solution or the like) and a cap which closes a filler port formed in the vapor manifold set in place to hermetically seal the system. A suitable amount of similar coolant is also placed in the reservoir.

Under these conditions, the cooling circuit is placed in an essentially non-condensible matter free condition (viz., free from contaminating air which, if permitted to enter the radiator conduiting causes a remarkable reduction in heat exchange efficiency thereof).

When the engine is started as the coolant in the cooling system is not forcefully circulated, the portion of the same in the coolant jacket quickly heats and begins producing vapor pressure. At this time the reversible pump 230 is energized to pump coolant in a first flow direction (flow direction A) thus displacing coolant from the cooling circuit out to the reservoir 226.

During this "warm-up/displacement" process the data inputs from the engine speed and load sensors 246, 248 are read and the TARGET temperature for the instant set of operating conditions determined. In the event that the engine is operating in a cold environment (merely by way of example) and the temperature best suited for instant set of operating conditions is reached, the displacment of coolant is temporarily stopped by stopping the pump 230 irrespective if the levels of coolant in the coolant jacket 208 and the lower tank 220 are still above levels H1 and H2, respectively. Under these circumstances the coolant in the coolant jacket 208 is permitted to "distill" across to the radiator 216 until such time as the level of coolant in the coolant jacket lowers to H1 at which time the level sensor 240 outputs a signal and the control circuit 236 issues a command to start pump 224.

In order to obviate rapid on/off cycling of the coolant return pump 224 it is possible to either provide level sensor 240 with hysteresis characteristics or incorporate these characteristics into the program in the control circuit 236 which controls the operation of the pump.

In the event that the level of coolant in the lower tank 220 reaches level H2 the displacement of coolant in the first flow direction (A) is terminated in order to prevent the possibility of excess coolant being removed from the cooling circuit.

If the temperature of the coolant exceeds the TARGET value by a relatively small amount (for example 0.5° C.) fan 218 is energized in a manner to increase the flow of atmospheric air over the heat exchanging surfaces of the radiator 216 and thus promote a higher rate of heat removal. If the temperature drops by a similar amount the operation of the fan 218 is stopped in order to reduce the amount of heat exchange and promote an increase in temperature and pressure in the radiator 216. As proviously indicated if the rate of condensation is increased the pressure in the cooling circuit lowers and the boiling point of the coolant reduced and vice versa.

If the boiling point of the coolant deviates by a relatively large amount, for example in the order of 2°–4° C. then the amount of coolant in the radiator is adjusted. For example, if the temperature lowers, the control circuit energizes pump 230 in a second flow direction (i.e. flow direction B) which increases the amount of coolant contained in the lower tank 220 in a manner that the level of coolant in the radiator rises. This reduces the amount of "dry" surface area available for the coolant vapor to release its latent heat of evaporation and thus reduce the amount of heat which can be removed from the system. This of course compensates for the "overcooled" condition and promtes a rapid increase in coolant boiling point.

In the event that the reverse situation occurs, coolant is pumped out of the lower tank 220 to increase the "dry" surface area available for the coolant vapor to release its laternt heat of evaporation. However, as mentioned earlier, if the level of coolant in the lower tank 220 reaches H2 then further displacement is terminated. In the event that operation of the fan does not bring the high temperature condition under control it is possible to momentarily open valve 234 and vent some of the coolant vapor out to the reservoir 226 via conduit 232. In this embodiment conduit 232 communicates with a lower section of the reservoir 226 whereby a kind of "stream trap" is formed which condenses essentially all of the vented vapor and permits any air of the like which may be discharged with the coolant vapor to escape to the ambient atmosphere via air bleed 233. If repeated ventings fail to lower the temperature it is possible limit the engine speed and issue an abnormal condition warning.

When the engine 200 is stopped as amount of heat which is contained in the engine structure will continue to boil the coolant for a short period after the engine operation actually stops, it is necessary to execute a "cool-down" control which continues operation of fan 218 until such time as the pressure in the cooling circuit becomes slightly sub-atmospheric. By de-energizing the system at this time, coolant from the reservoir 226 is inducted via conduit 232 into the cooling circuit under the influence of the pressure differential until such time as the cooling circuit is completely filled or the pressure differential ceases to exist.

In order to ensure that the cooling circuit continues to remain essentially free of air or the like non-condensible matter, each time the engine 200 is started and the coolant temperature is below a predetermined level, a "non-condensible matter purge" is effected. During this mode of operation pump 230 is energized in the second flow direction and valve 234 temporarily de-energized to open same. As the cooling circuit is essentially full of liquid coolant at this time, as coolant is forced into the lower tank 220 the excess coolant in the system overflows via conduit 232 back to the reservoir 226. In this embodiment the pump 230 is maintained in the above mentioned state for a period of about 10 seconds. However, as will be appreciated this period may be suitably varied with the type of engine or the climate in which the engine is being used. Viz., in extremely cold regions it is possible that contaminating air will not induce engine overheat conditions and may be omitted or shortened.

For further discussion relating to the above mentioned control reference may be had to copending U.S. patent application Ser. No. 780,263 filed on Sept. 26, 1985 in the same of SHIMONOSONO et al. The content of this document is hereby incorporated by reference thereto.

Figure 9:
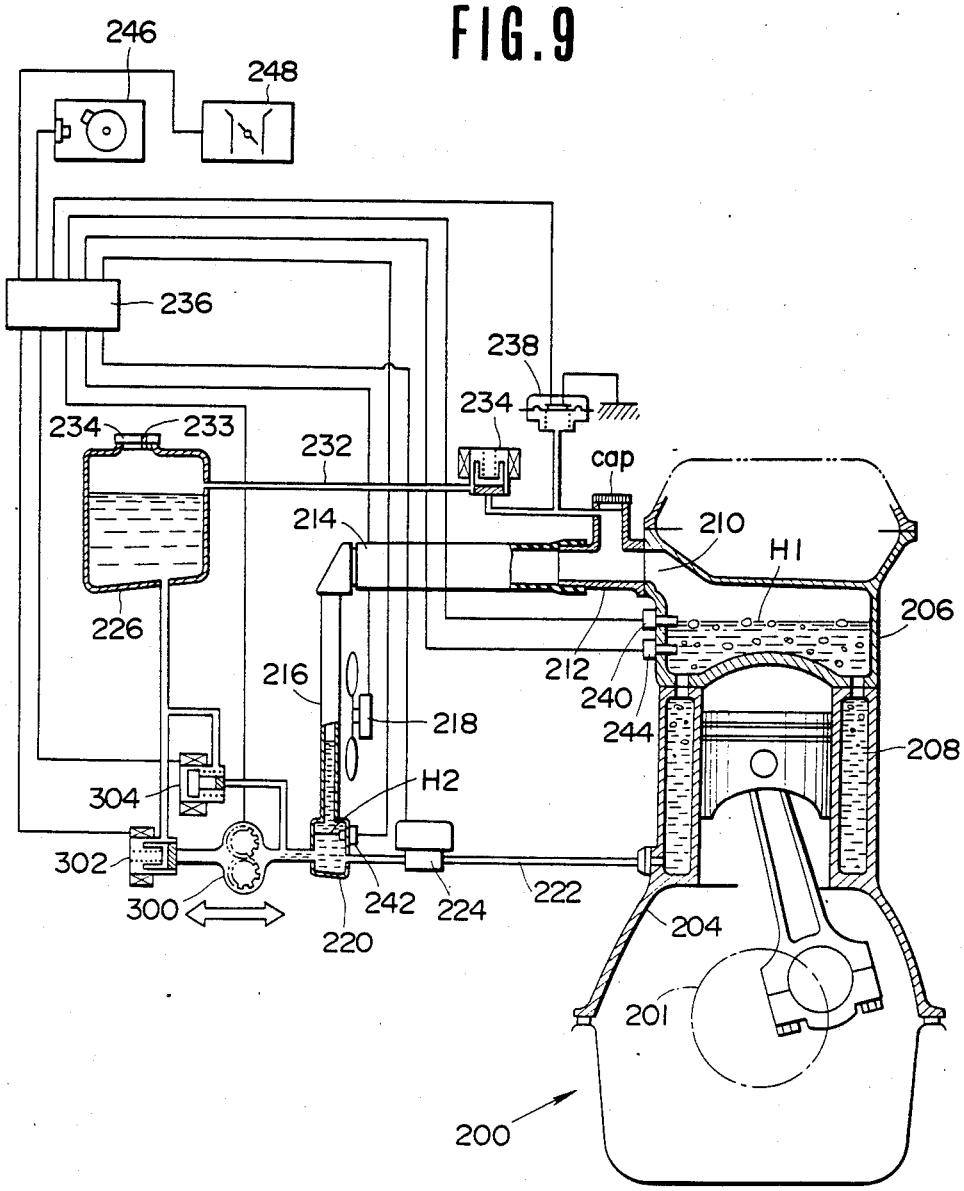
FIGS. 9 to 11 show second, third and fourth embodiments of the present invention, respectively.

FIG. 9 shows a second embodiment of the present invention. This arrangement is essentially the same as that described in connection with FIG. 8 and differs only in that the pump 230 is relaced with an arrangement including a pump 300 (which may take the form of a gear pump, a troichiod pump, cascade pump or the like) and ON/OFF type electromagnetic valves 302 and 304. In this arrangement valve 302 is arranged to control commuication between the reservoir 226 and the port of pump 300 which functions as a discharge port when the pump is operating to pump in a first flow direction (A), while valve 304 is arranged to control communication betwen the reservoir 226 and a short conduit 305 which interconnects the pump 300 and the lower tank 220.

This arrangement ensures that communication between the reservoir 226 and the cooling circuit will be hermetically cut-off when desired and also permits the use of a commonly used pump which does not necessary provide a perfect seal between the ports thereof when not in operation. Further, this arrangement permits coolant be displaced out of the system (via valve 304) under the influence of the vapor pressure which is produced during engine warm-up as different from the positive pumping technique used in the first embodiment. This arrangement also permits coolant to be inducted via valve 304 following engine shut-down and/or for, in the event of abnormally high temperatures, coolant vapor to be vented from the bottom of the radiator in a manner which induces coolant vapor to rush downwardly through the radiator tubing and flush out any pockets of air or the like which may be trapped therein (and inducing the overheat).

Other than the above, the operation of the second embodiment is essentially the same as the first one and thus a description of the same will be omitted.

Figure 10:
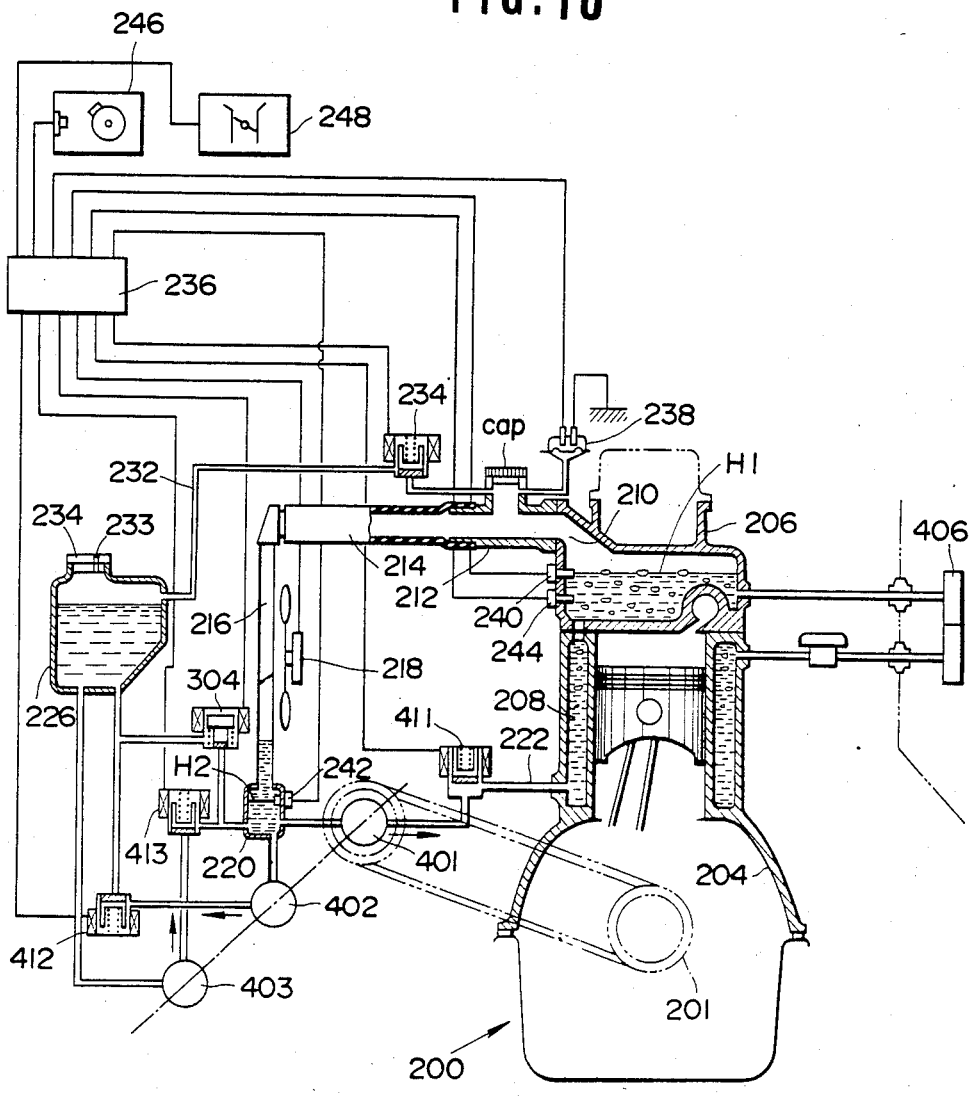

FIG. 10 shows a third embodiment of the present invention. In this arrangement the electrically powered pumps which are employed in the arrangements of FIGS. 8 and 9 are replaced with constantly operated ones (401, 402, 403) which are driven via a mechanical connection (belt) with the crankshaft 201 of the engine. As these pumps are not readily reversible it is necessary to increase the number thereof and provide a valve (411, 412, 413) for each so that the supply thereof can be controlled in a desired manner.

This arrangement is deemed advantageous in that as the pumps 401, 402 and 403 are continously operated, the response characteristics of the system are improved. That is to say, with the electrically powered pumps as they are subject to on/off operation, a finite time is required for the pump to reach operational speed and produce the required flow after being started; while on the other hand, when de-energized continue to operate as they slow down to a halt and tend to produce an "overshoot" in the intended coolant control. Additionally, these type of pumps in combination with other electrically operated vehicle apparatus tend to place a high drain on the engine battery. Further, the rotational energy-electricity-rotational energy conversion is bypassed and use of the original rotational energy directly empoyed.

It will be noted that when the respective valves 411, 412 and 413 of the pumps 401, 402 and 403 are closed, the pumps consume very little power as they are prevented from performing any effective work.

The operation of this embodiment is smilar to those disclosed hereinbefore but differ in that valves 411, 412 and 413 are conrolled rather than the pumps per se. Viz., the output of coolant return pump 401 is controlled by valve 411. This valve 411 is opened and closed in accordance with the output of level sensor 244. On the other hand valve 412 is opened when it is necessary to pump coolant out of the cooling circuit while valve 413 is opened in the event that it is necessary to pump additional coolant into the system. Valve 304 performs the same function as corresponding one of the second embodiment.

Figure 11:
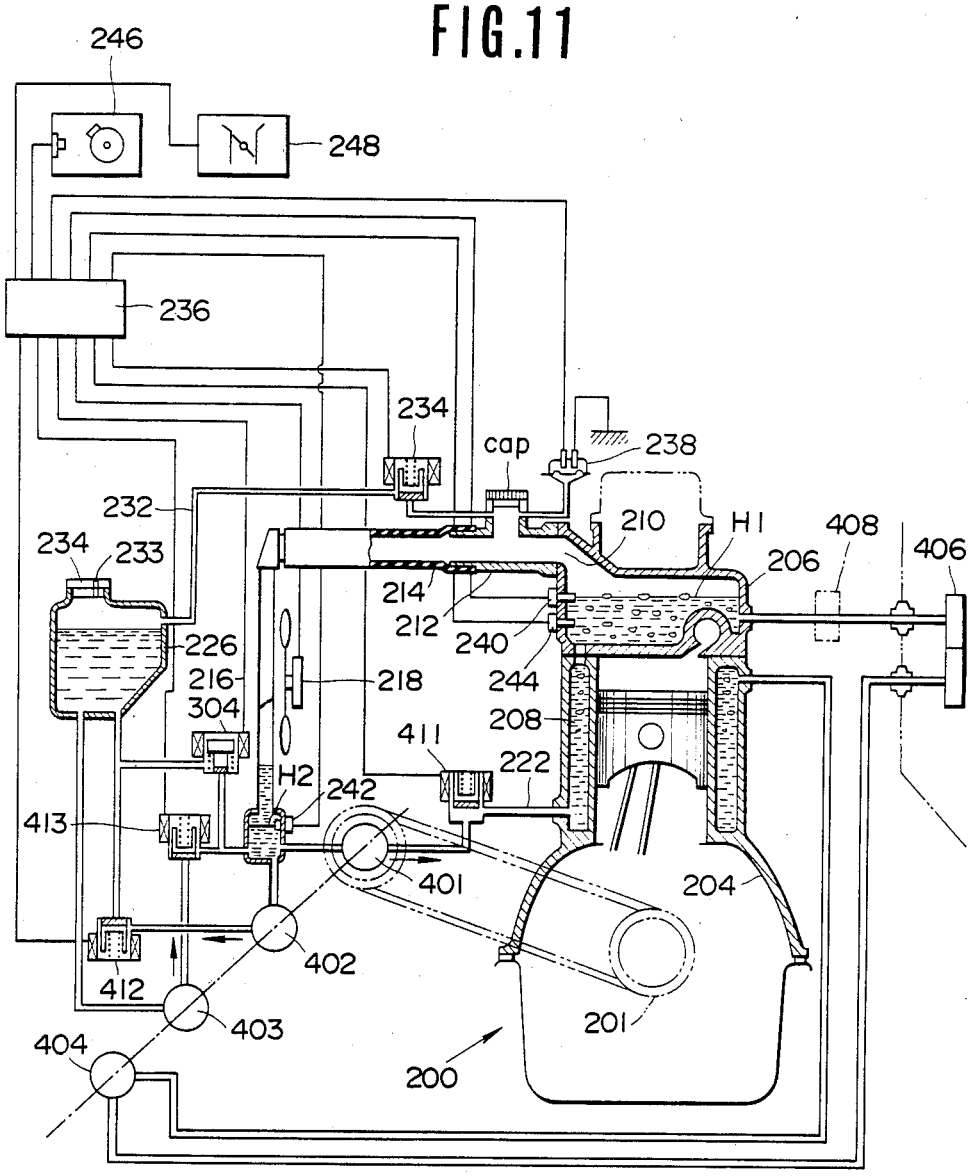

FIG. 11 shows a fourth embodiment of the present invention. This arrangement is essentially identical to that of the third embodiment and features the arrangement wherein the pump 404, which circulates coolant from the coolant jacket 208 through the cabin heater core 406, is mechanically driven by the same connection used to drive pumps 401–403. In order to control the heating provided by the heat core it is possible to insert a flow control valve 408 in a suitable location in the heater circuit such as shown in phantom.

Figure 1:
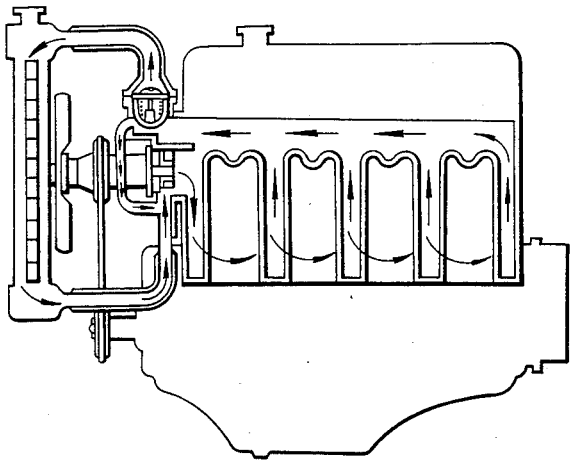
FIG.1 (PRIOR ART)
FIG. 1 is a partially sectioned elevation showing a conventional circulation type cooling system discussed in the opening paragraphs of the instant disclosure.
Figure 2:
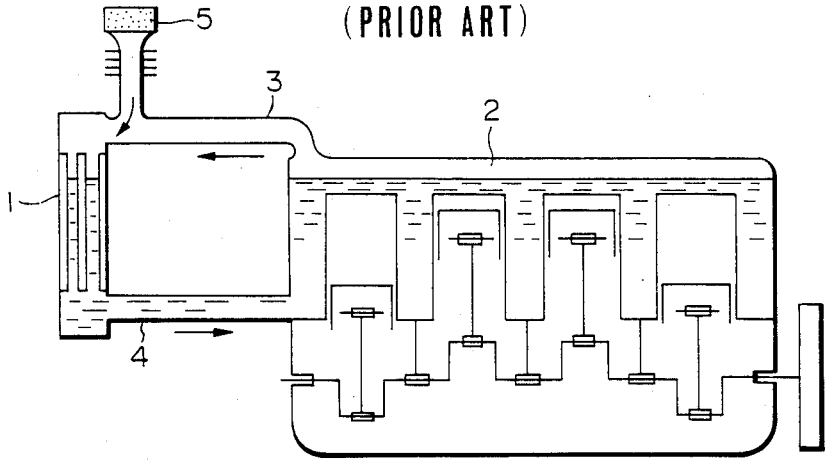
FIG.2 (PRIOR ART)
FIG. 2 is a schematic side sectional elevation of a prior art arrangement also discussed briefly in the earlier part of the specification.
Figure 3:
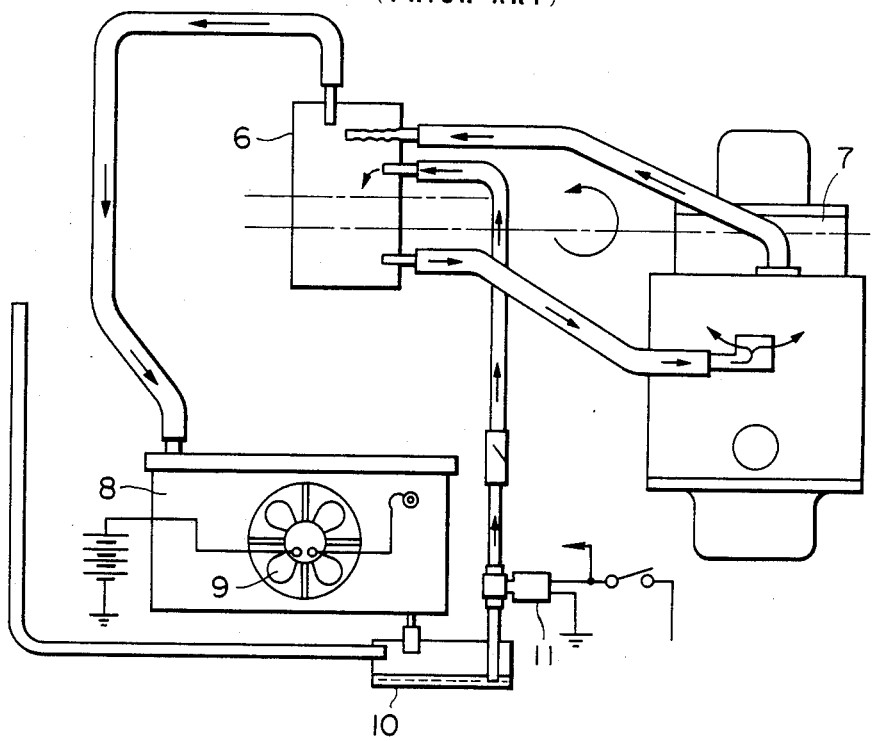
FIG.3 (PRIOR ART)
FIG. 3 shows in schematic layout form, another of the prior art arrangements previously discussed.
Figure 4:
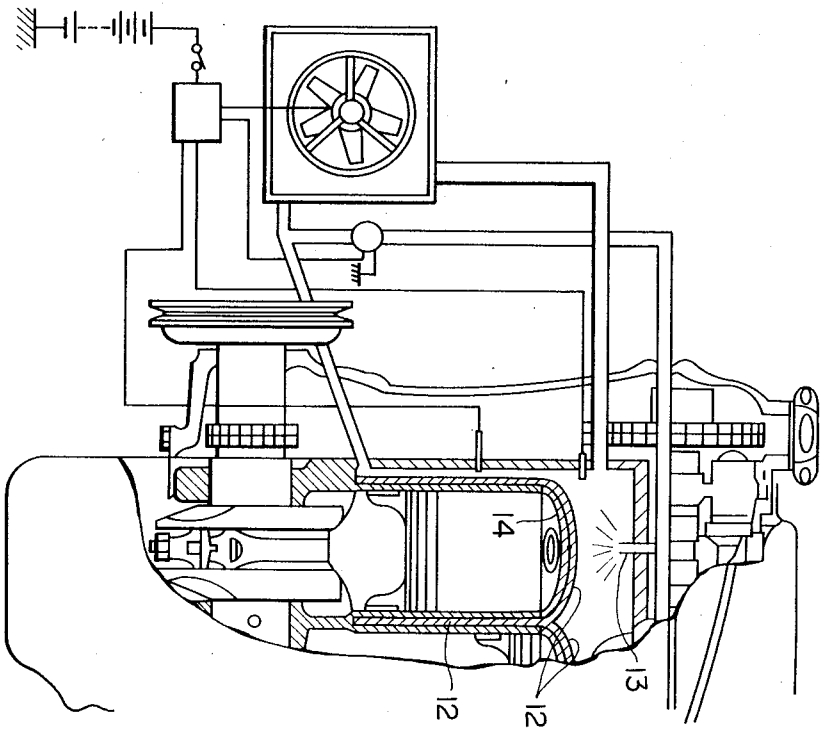
FIG.4 (PRIOR ART)
FIG. 4 shows in partial section yet another of the previously discussed prior art arrangements.

In the embodiments wherein the pumps are driven by a mechanical connection with the crankshaft the size (capacity) of the pumps 1/10th or less of that shown in FIG. 1 and hence consume little power. The electrically driven ones have essentially the same displacement.

What is claimed is:

1. In an internal combustion engine having a structure subject to high heat flux, (a) a cooling system for removing heat from said engine comprising:

a cooling circuit which includes:

a coolant jacket formed about said structure, said coolant jacket being arranged to receive coolant in liquid form and discharge same in gaseous form;

a radiator which fluidly communicates with said coolant jacket by way of a coolant transfer conduit and in which gaseous coolant produced in said coolant jacket is condensed to its liquid form;

a return conduit leading from said radiator to said coolant jacket for returning coolant condensate from said radiator to said coolant jacket; and a return pump disposed in said return conduit, said return pump being selectively energizable to maintain a predetermined level of coolant in said coolant jacket;

(b) a reservoir the interior of which is maintained constantly at atmospheric pressure; and (c) a volume control pump fluidly interposed between said reservoir and said cooling circuit for pumping coolant between said cooling circuit and said reservoir in a manner which varies the amount of coolant in said cooling circuit.

2. A cooling system as claimed in claim 1, wherein said volume control pump is reversible in a manner which permits coolant to be pumped from said reservoir into said cooling circuit and from said cooling circuit to said reservoir.

3. A cooling system as claimed in claim 2, further comprising a second volume control pump fluidly interposed between said reservoir and said cooling circuit, said first volume control pump being arranged to pump coolant in a first flow direction out of said cooling circuit to said reservoir and said second volume control pump being arranged to pump coolant in a second flow direction from said reservoir into said cooling circuit.

4. A cooling system as claimed in claim 3, wherein said first and second volume control pumps are constantly driven by a mechanical connection with said engine and which further comprises second and third control valves disposed on discharge sides of said first and second volume control pumps respectively.

5. A cooling system as claimed in claim 2, further comprising a first level sensor disposed in said coolant jacket, said first level sensor being arranged to sense the presence of liquid coolant at a predetermined height above the structure subject to high heat flux and output a signal indicative of the coolant temperature to said control circuit, said first level being selected to maintain the structure securely immersed in a predetermined depth of liquid coolant.

6. A cooling system as claimed in claim 5, wherein said return pump is responsive to said first level sensor in a manner that when said first sensor detects the level of coolant being below said predetermined level said return pump is energized in a manner to pump liquid coolant from said radiator to said coolant jacket.

7. A cooling system as claimed in claim 5, wherein said return pump is driven via a mechanical connection with the engine and which further comprises a first valve which is disposed in said return conduit at a location between said return pump and said coolant jacket, said first valve being responsive to the output of said first level sensor in a manner to open and permit coolant from said pump to be supplied to said coolant jacket when said level sensor indicates that the level of liquid coolant in said coolant jacket is below said predetermined level.

8. A cooling system as claimed in claim 5, further comprising a second level sensor, said second level sensor being disposed in a small collection vessel formed at the bottom of said radiator for sensing the level of coolant being at a second predetermined level which is lower than the heat exchanging surface of said radiator, said second level sensor being operatively conneced with said control circuit.

9. A cooling system as claimed in claim 8 wherein said second predetermined level is selected so that when the level of liquid coolant in said coolant jacket is at said first predetermined level and the level of coolant in the small collection vessel is at said second predetermined level the minimum amount of coolant which should be retained in the cooling circuit is contained therein.

10. A cooling system as claimed in claim 8, further comprising a pressure differential responsive switch arrangement which is responsive to the pressure differential which exists between the interior of said cooling circuit and the ambient atmosphere.

11. A cooling system as claimed in claim 10, further comprising a temperature sensor, said temperature sensor being disposed in said coolant jacket in a manner to be immersed in the liquid coolant contained therein, said temperature sensor being arranged in proximity of the structure object to high heat flux.

12. A cooling system as claimed in claim 11, further comprising a device disposed with said radiator, said device being arranged to induce a change in the heat exchange between the radiator and a cooling medium surrounding said radiator.

13. A cooling system as claimed in claim 12, wherein said control circuit is responsive to said first level sensor, said second level sensor, said temperature sensor and said pressure differential responsive switch arrangement for controlling the operation of said device, said coolant return pump and said volume control pump.

14. A cooling system as claimed in claim 2, further comprising:

a transfer conduit which leads from an upper section of the cooling circuit to said reservoir;

fourth control valve disposed in said transfer conduit, said fourth control valve being controlled by said control circuit and arrnaged to have a first a first state wherein communication between said cooling circuit and said reservoir is cut-off and a second state wherein the communication is permitted.

15. A cooling system as claimed in claim 14, wherein said transfer conduit communicates with a lower section of said reservoir so that when said control valve is induced to assume said second state and a negative pressure prevails in said cooling circuit, coolant from said reservoir is inducted through said transfer conduit into said cooling circuit while in the event that a super-atmospheric pressure prevails in said cooling circuit, coolant vapor is permitted to bubble through the liquid coolant in said reservoir and induced to condense.

16. A cooling system as claimed in claim 1, further comprising a fifth control valve fluidly interconnecting said cooling circuit and said reservoir, said fifth valve being controlled by said control circuit and arranged to fluidly communicate with one of (a) the lower section of said radiator and (b) said coolant return conduit at a location between said radiator and said coolant return pump, said fifth control valve having a first state wherein communication between said reservoir and said cooling circuit is cut-off and a second state wherein communication is permitted, the arrangement of said fifth communication valve being such that when a sub-atmospheric pressure prevails in said cooling circuit and said fifth valve is induced to assume the second state coolant is inducted from said reservoir into said coolant jacket, while in the event that the pressure in said coolant jacket is super-atmospheric and said fifth valve is induced to assume said second state, coolant from said is displaced out of said cooling circuit to the reservoir.

17. A cooling system as claimed in claim 1, further comprising a control circuit, said control circuit being arrnaged to control said return pump and said volume control pump.

* * * * *